US009091054B2

(12) United States Patent
Greiner et al.

(10) Patent No.: US 9,091,054 B2
(45) Date of Patent: Jul. 28, 2015

(54) MEMBRANE ELEMENT AND METHOD FOR COVERING SURFACES, MORE PARTICULARLY FOR CEILINGS OR WALLS

(76) Inventors: Switbert Greiner, Oberaichen (DE); Christofer Gutmann, Achern (DE)

( * ) Notice: Subject to any disclaimer, the term of this patent is extended or adjusted under 35 U.S.C. 154(b) by 891 days.

(21) Appl. No.: 12/522,461

(22) PCT Filed: Jan. 7, 2008

(86) PCT No.: PCT/EP2008/000046

§ 371 (c)(1),
(2), (4) Date: Jul. 8, 2009

(87) PCT Pub. No.: WO2008/083940

PCT Pub. Date: Jul. 17, 2008

(65) Prior Publication Data

US 2010/0050543 A1 Mar. 4, 2010

(30) Foreign Application Priority Data

Jan. 9, 2007 (DE) ..... 10 2007 001 376

(51) Int. Cl.
*E04C 2/00* (2006.01)
*E04B 9/30* (2006.01)
(Continued)

(52) U.S. Cl.
CPC ..... *E04B 9/306* (2013.01); *E04F 13/005* (2013.01); *E04B 2009/0492* (2013.01)

(58) Field of Classification Search
CPC ..... E04B 9/306; E04B 2009/0492; E04B 2002/7479; E04F 13/005; F16B 5/0092; F16B 5/0233
USPC ..... 52/506.01, 506.05, 506.08, 506.09, 52/222, 127.7, 127.8, 22, 291
See application file for complete search history.

(56) References Cited

U.S. PATENT DOCUMENTS 3,017,970 A * 1/1962 Nickols ..... 52/127.12
3,848,380 A * 11/1974 Assael ..... 52/222
3,909,994 A * 10/1975 Richter ..... 52/63
(Continued)

FOREIGN PATENT DOCUMENTS

DE 2835928 A1 2/1980
DE 10253343 A1 5/2004
(Continued)

OTHER PUBLICATIONS

PCT, "International Preliminary Report on Patentability" (Translation), International Application No. PCT/EP2008/000046 and International Filing Date Jan. 7, 2008, pp. 1-2.
(Continued)

*Primary Examiner* — Brian Glessner
*Assistant Examiner* — Jessie Fonseca
(74) *Attorney, Agent, or Firm* — Hoffman Warnick LLC

(57) ABSTRACT

The invention relates to a membrane element for covering surfaces, more particularly for covering ceilings or walls, comprising a frame and a membrane material stretched over said frame. The membrane element is characterized in that at least one frame region is bent inwardly due to forces exerted on the frame by the membrane material and that the inwardly bent frame region has tightening units for pulling or pushing said frame region outwardly with respect to an abutment, towards the unbent state. The invention further relates to a method for covering surfaces, more particularly for covering ceilings or walls.

30 Claims, 17 Drawing Sheets

(51) Int. Cl.
*E04F 13/00* (2006.01)
*E04B 9/04* (2006.01)

(56) References Cited

U.S. PATENT DOCUMENTS

| | | | | |
|---|---|---|---|---|
| 4,036,244 | A * | 7/1977 | Huddle | 52/63 |
| 4,457,117 | A * | 7/1984 | Leiher et al. | 52/238.1 |
| 4,817,655 | A * | 4/1989 | Brooks | 135/121 |
| 5,027,564 | A * | 7/1991 | Lechner | 52/2.23 |
| 5,209,029 | A * | 5/1993 | Foerst | 52/63 |
| 5,333,425 | A * | 8/1994 | Nickerson et al. | 52/222 |
| 6,318,215 | B1 * | 11/2001 | Armfield, IV | 81/58.2 |
| 6,324,797 | B1 * | 12/2001 | Fago et al. | 52/222 |
| 6,421,968 | B2 * | 7/2002 | Degelsegger | 52/204.62 |
| 6,789,978 | B1 * | 9/2004 | Yoshinari | 403/381 |
| 7,849,639 | B2 * | 12/2010 | Sprung | 52/82 |
| 2002/0035811 | A1 * | 3/2002 | Heuel | 52/506.05 |
| 2002/0152704 | A1 * | 10/2002 | Thompson et al. | 52/506.06 |
| 2004/0168383 | A1 * | 9/2004 | Reynolds et al. | 52/273 |
| 2007/0039250 | A1 * | 2/2007 | Morris | 52/22 |
| 2010/0037544 | A1 * | 2/2010 | Musgrave et al. | 52/222 |
| 2011/0061320 | A1 * | 3/2011 | Scherrer | 52/222 |

FOREIGN PATENT DOCUMENTS

| | | | |
|---|---|---|---|
| WO | 9900562 | A1 | 1/1999 |
| WO | 0208534 | A1 | 1/2002 |

OTHER PUBLICATIONS

Roberto Righetti, “International Search Report”, Completion Date Jun. 4, 2008, International Application No. PCT/EP2008/000046, International Filing Date Jan. 7, 2008.

* cited by examiner a)

b)

MEMBRANE ELEMENT AND METHOD FOR COVERING SURFACES, MORE PARTICULARLY FOR CEILINGS OR WALLS

FIELD OF THE INVENTION

The present invention relates, in a first aspect, to a membrane element for covering surfaces, more particularly for covering ceilings or walls.

The invention further relates to a method for covering surfaces, more particularly for covering ceilings or walls.

Finally, the invention relates to a revetment for a surface consisting of membrane elements of the invention.

A generic membrane element comprises a frame and a membrane material stretched over said frame.

In a generic method for covering a surface, more particularly for covering a wall or a ceiling, membrane elements comprising a frame and a membrane material stretched over said frame are attached side by side to the surface to be covered.

RELATED ART

In prior frame systems, the tensile forces necessarily arising from the stretched membrane elements are absorbed over the entire length of the frame edges resulting in bending of the membrane elements. Therefore, relatively thick profiles are required in order to minimize the deformation resulting from this stress. This results in high material usage, high weight, and high costs and is undesirable, particularly in the case of backlit membrane elements, since the thick frame profiles become visibly apparent. In an additional variant known from the prior art, the membrane tension is built up by a spring mechanism disposed inside the frame. This mechanism is technically complex and also takes up considerable space in terms of the width of the profile.

SUMMARY OF THE INVENTION

It is an object of the present invention to provide a membrane element and a method for covering surfaces, which membrane element and method permit a surface to be covered with the aid of much thinner frame structures.

The membrane element of the type cited above is further developed, according to the invention, in that at least one frame region is bent inwardly as a result of forces exerted on the frame by the membrane material and that tightening units are provided on the inwardly bent frame region to pull or press said frame region outwardly with respect to an abutment, towards the unbent state.

The method for covering surfaces of the type described above is further developed, according to the invention, in that the frames of the membrane elements are pre-tensioned by the membrane material, at least one frame region bending inwardly as a result of the forces exerted by the stretched covering material, that the pre-tensioned membrane elements comprising bent frame regions are fixed to the surface to be covered and that for closing the revetment, at least one or more of the membrane elements having inwardly bent frame regions are tightened or pressed together with frames of adjacent membrane elements.

One main concept of the invention relates to the fact that it is important to keep the visible width of the profiles as thin as possible. This provides the frame system with a decisive advantage, particularly when used in lighting systems.

The inventors then found that the bending occurring in thin frames or at least in some frame regions thereof can be eliminated in a simple manner by pushing or pulling the inwardly bent frame regions outwardly toward an adjacent abutment.

An important basic concept of the invention is thus to keep the frames sufficiently thin so as to allow at least parts of the frame to be bent inwardly due to forces exerted on the frame by the membrane material.

Finally, a central concept of the invention consists in the provision of tightening units in the region of the inwardly bent frame parts for the purpose of pulling or pushing these frame parts outwardly with respect to an abutment, towards the unbent state.

A first important advantage of the invention is that considerably thinner frames than in the prior art are made possible, providing much more freedom, for example in the field of light design.

A further important advantage and central concept of the invention is that the assembly, more particularly the opening and/or closing, of the revetment can be carried out from the front and especially from a face side thereof. This considerably facilitates mounting of the revetment of the invention.

The frame elements provided by the invention are suitable for covering plane surfaces or surfaces curved in one direction, preferably in the architectural sector, for example, for covering ceilings, walls, or panels for interior and exterior use. The frames described herein can be covered with films, fabrics, particularly coated fabrics, light scattering films or non-woven fabrics of all types. The membrane elements can thus be used for decorative purposes or for lighting and/or illuminating purposes in addition to their covering function. Furthermore, the revetment of the invention and the membrane elements of the invention can have an acoustic function; that is to say, they can serve for damping or reducing noise and sounds. Frequently, a combination of the aforementioned functions is desired.

The novelty of the invention thus consists in the manner in which the membranes are tightened, the thinness of the frame elements which is of advantage particularly in the case of backlit surfaces, and finally the ease of mounting and of partially or completely demounting membrane elements once installed.

In a particularly preferred variant, the frame of the membrane element is covered on both sides, in which case the membrane material on the first side can be a light scattering material and the membrane material on the second side can be a translucent material. The light scattering material ensures that the optical effect is not adversely affected by dirt, for example, dead insects, and that the contour of the lamps does not show.

In preferred embodiments of the revetment of the invention, light sources are present for backlighting the membrane elements. Numerous new designs are possible for this purpose, due to the considerably thinner frames that can be realized by virtue of the invention.

In principle, the membrane material can be attached to the frame in any desired way, for example, by implementing a plurality of separate connection points, e.g. clamps. An easily obtained and crease-free connection of the membrane material to the frame is realized by attaching the membrane material to the frame using a Keder.

Basically, the frame can be made of known materials suitable for this purpose in their mechanical properties, such as plastics materials. The frame is very advantageously made of aluminum profiles, particularly profiles having a semi-elliptical cross-section.

Basically, the abutment can be formed by any mechanically suitable object. Inwardly bent frame regions of an adjacent membrane element serve particularly well as abutments.

These inwardly bent frame regions are then pulled or pressed together in the manner proposed by the invention so that the forces occurring in the frames are counter-balanced. The number of tightening units provided on the frame regions is advantageously governed by the length of the frame regions to be pulled or pressed together and additionally by the elasticity of the membrane material.

In an alternative variant, edge profiles that may contain, in particular, installatory components such as electrical supply lines or data lines, can also serve as the abutment.

In a particularly preferred variant of the membrane element of the invention, the tightening units comprise bolted joints for pulling the bent frame regions toward the abutment. Tightening units of such type are easy and economical to produce and perform their function reliably. In order to keep the production costs for the frame profiles within limits, slot nuts for the bolted joints can be secured in the frame and in addition threaded bolts may be present for screwing the slot nuts together, particularly in opposing frame regions. These slot nuts are basically threaded nuts.

In order to pull opposing frame regions together, in a simple exemplary embodiment, the threaded bolt can have a right-hand thread over one end region thereof and a left-hand thread over the other, the slot nuts being provided with corresponding threads.

Screwing of the threaded bolts into the slot nuts is easily accomplished when the slot nuts are secured in the frame with a certain degree of play.

In a further preferred alternative characterized by particularly reliable operability, a drive wheel, in particular with a toothed wheel, is provided in the frame for turning the threaded bolt.

A functionality particularly designed for closing the tightening units is achieved when the threaded bolt has a tapered region for passage through the slot nut, a rear stop for securing it from displacement against the drive wheel and a front stop for securing it from displacement against the slot nut.

A recess is advantageously formed in the frame in the region of the tightening units to allow for access to the tightening units with the aid of a tool. This can be achieved in aluminum profiles in an uncomplicated manner known per se.

Particularly well-controlled and reliable work is possible when stop means, particularly screws, are provided in the frame in the region of the recess for defined positioning of the tool.

Alternatively, the tightening units may comprise clamp-connections. In a simple variant, a clamp-connection is achieved by a separate clamping member that can be fitted on the frame and, in particular, is displaceable.

In accordance with the method of the invention, the corner regions of the inwardly bent frame regions of adjacent membrane elements are pushed together by means of at least one clamping piece that can have, in particular, a U-shaped or H-shaped profile by fitting the clamping piece on the corner regions of both frames and then pushing the clamping piece away from the corner region, as a result of which the inwardly bent frame regions of the adjacent membrane elements are pushed together. If appropriate, several such clamping pieces can be provided and fitted on the two frame regions to be joined.

For the purpose of cleaning or maintenance, the membrane elements can be removed entirely or merely swiveled out by loosening the tightening units.

BRIEF DESCRIPTION OF THE DRAWING

Additional characteristics and features of the membrane element of the invention, the method of the invention and the revetment of the invention are described below with reference to the accompanying diagrammatic figures, in which.

DETAILED DESCRIPTION OF THE INVENTION

Figure 1:
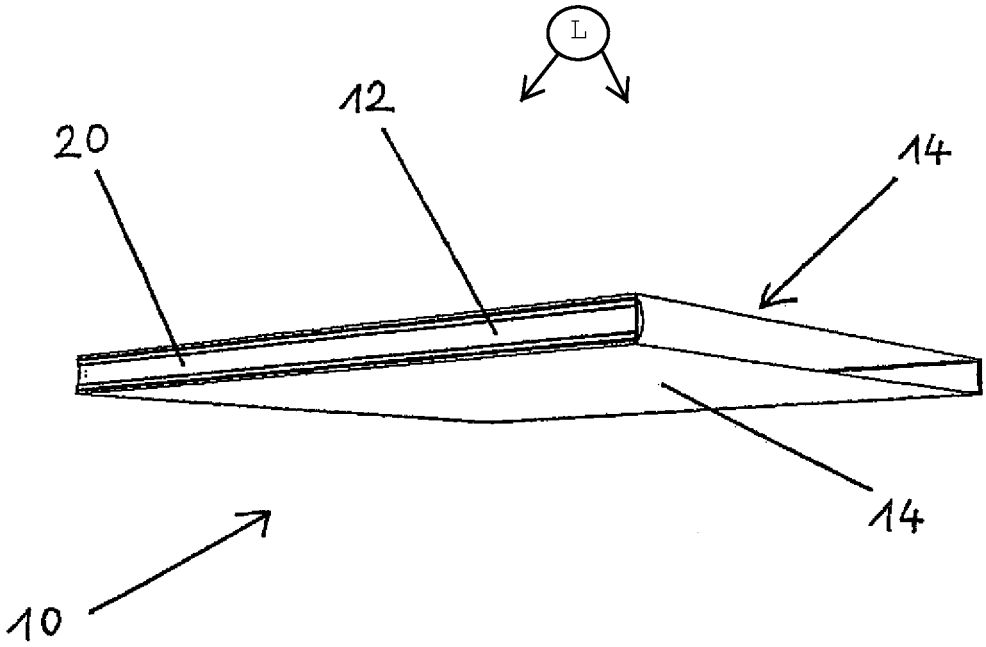
FIG. 1: is a diagrammatic view of a membrane element of the invention.

The basic concept of the invention will now be described with reference to the exemplary embodiments shown diagrammatically in FIGS. 1, 6, and 7. In all figures, like components are designated by like reference numerals.

Figure 6:
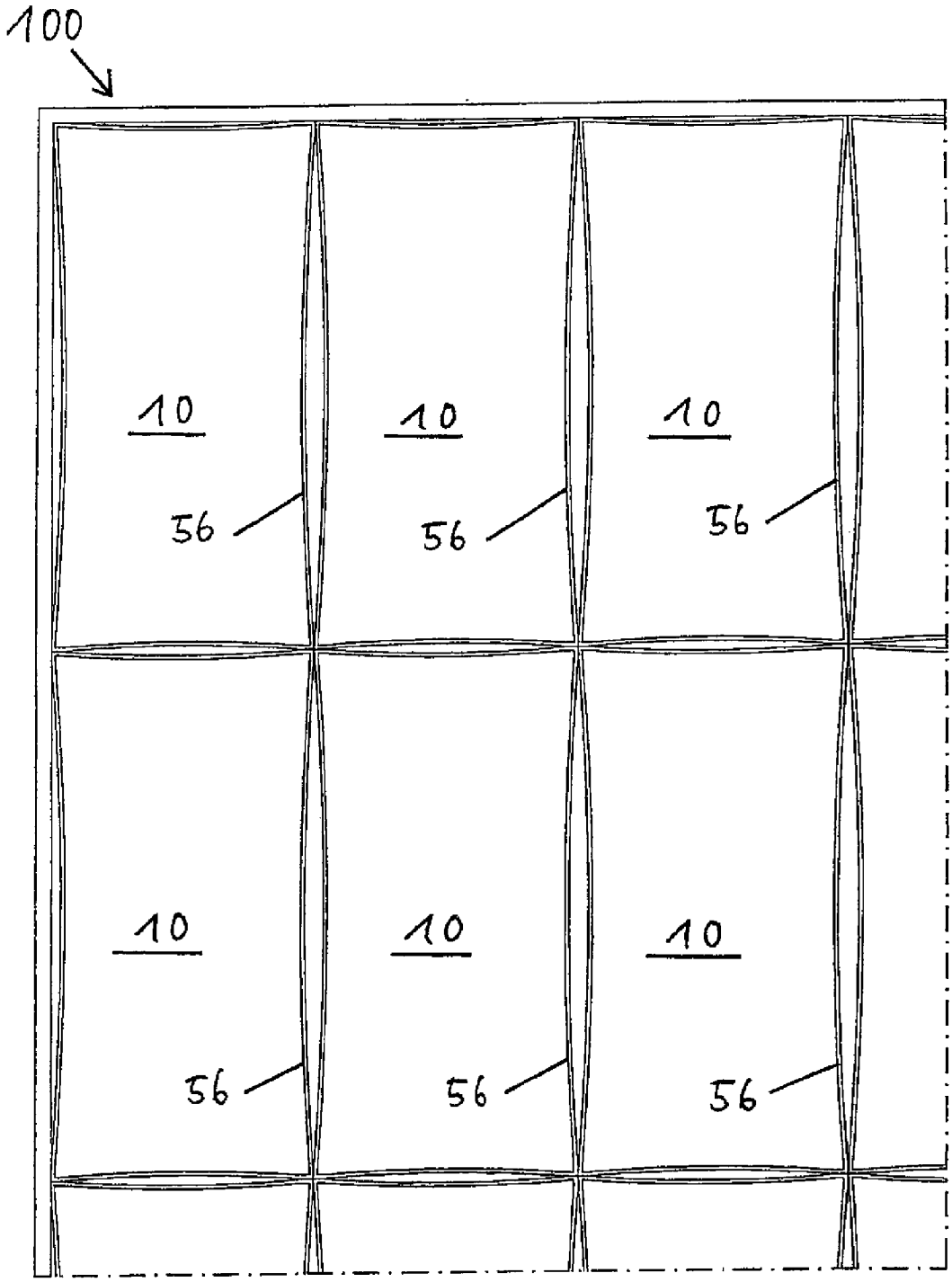
FIG. 6: shows a revetment of the invention before the membrane elements are pulled together.
Figure 7:
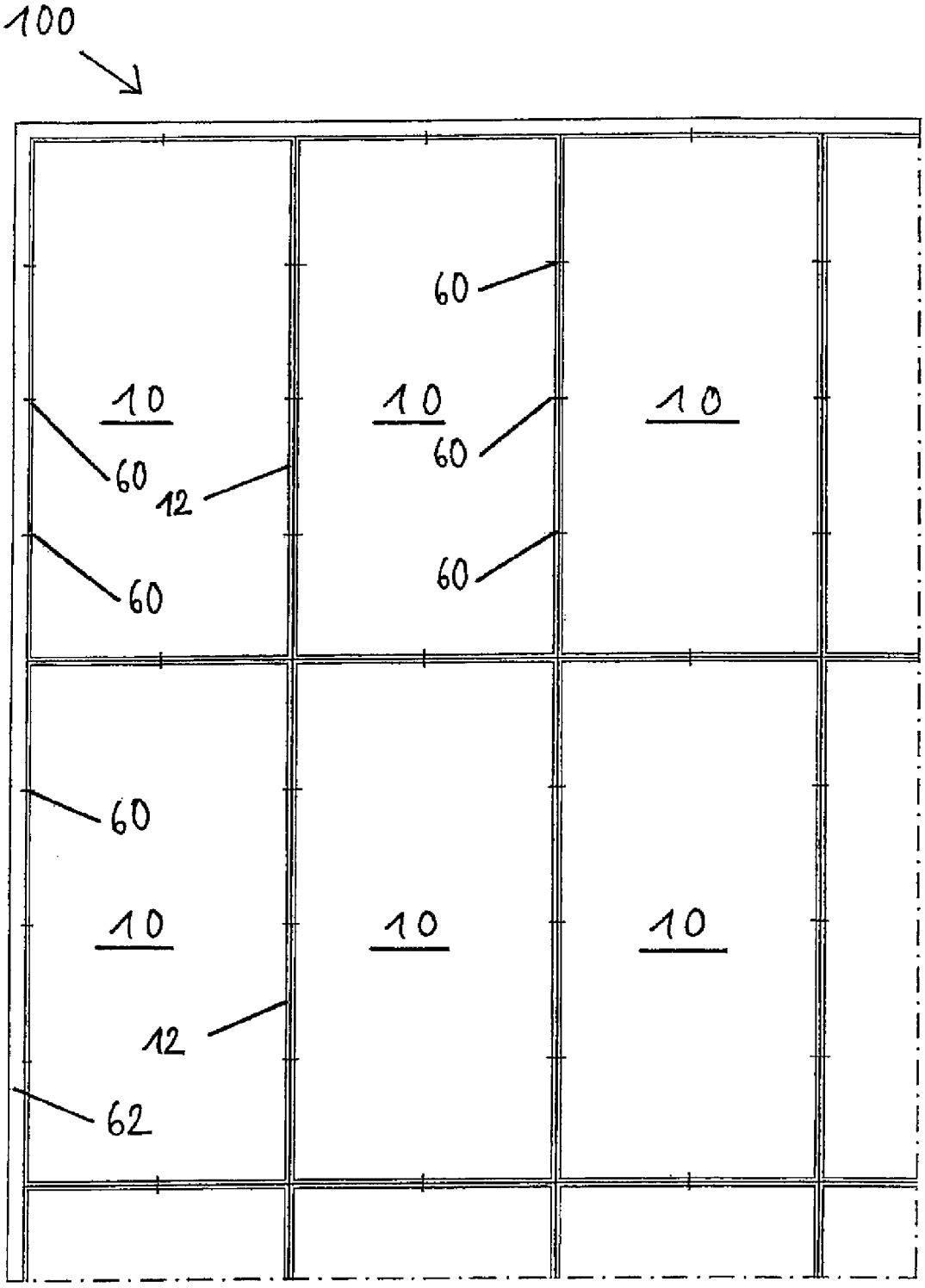
FIG. 7: shows a revetment of the invention comprising diagrammatically indicated tightening units in the state in which the membrane elements are pulled together.

FIG. 6 shows diagrammatically a revetment 100 for a surface such as a ceiling, Substantially comprising a plurality of membrane elements 10 of the invention. A membrane element 10 of the invention, shown diagrammatically in a partial sectional view in FIG. 1 with a light source L and comprises a frame 12 and a membrane material 14 stretched over both sides thereof. The membrane material 14 stretched over the frames 12 of the membrane elements 10 exerts inwardly directed forces on the frames 12 so that frame regions 56 are bent inwardly, as indicated diagrammatically in FIG. 6.

The central concept of the invention is to provide the inwardly bent frame regions 56 with tightening units 60, with the aid of which the inwardly bent frame regions 56 of adjacent membrane elements 10 are pulled together or pressed on each other. This is shown diagrammatically in FIG. 7, where three tightening units 60 are provided on each of the long sides of the membrane elements 10 and one tightening unit is provided on each of the short sides. FIG. 7 shows the membrane elements 10 in the state in which they have been pulled or pressed together. The outer membrane elements 10 shown in FIG. 7 are screwed to an edge profile 62 with the aid of tightening units 60.

The frame profiles of the individual membrane elements are thus screwed together at one or more points so that the tensile forces arising from the cover are absorbed over a short span width. The profiles can thus be designed as thin units, this being an important advantage gained by the present invention. The bolted joint is designed in such a way that it can be activated in spite of the inaccessibility of the frame interior when the frame has been covered on both sides. This activation, for example, can be carried out with the aid of a special tool described in detail below, in a narrow seam between adjacent frames by way of a toothed wheel disposed there. Additional springs or other mechanisms for stretching the membrane are not required since the membrane material is itself elastic and acts as a spring. Stretching of the membrane, as necessary to attain a smooth appearance under realistically occurring external loads and temperature differences, and the necessary dimensional stability are imparted to the assembly when the individual frames are covered. The frame edge, still unsupported at this stage, is deformed as a result of such stretching and bends inwardly. The inwardly curved frame edges, for example of two frames lying opposite to one another, are bolted together during assembly and so the desired linearly stretched shape is achieved. This increases the tension in the membranes to a planned extent. By virtue of the fact that the membrane forces are transferred from one frame to the other by way of a number of distributed bolted joints, these forces are counter-balanced and thus make it possible to maintain the desired thinness of the frame profile.

Figure 8:
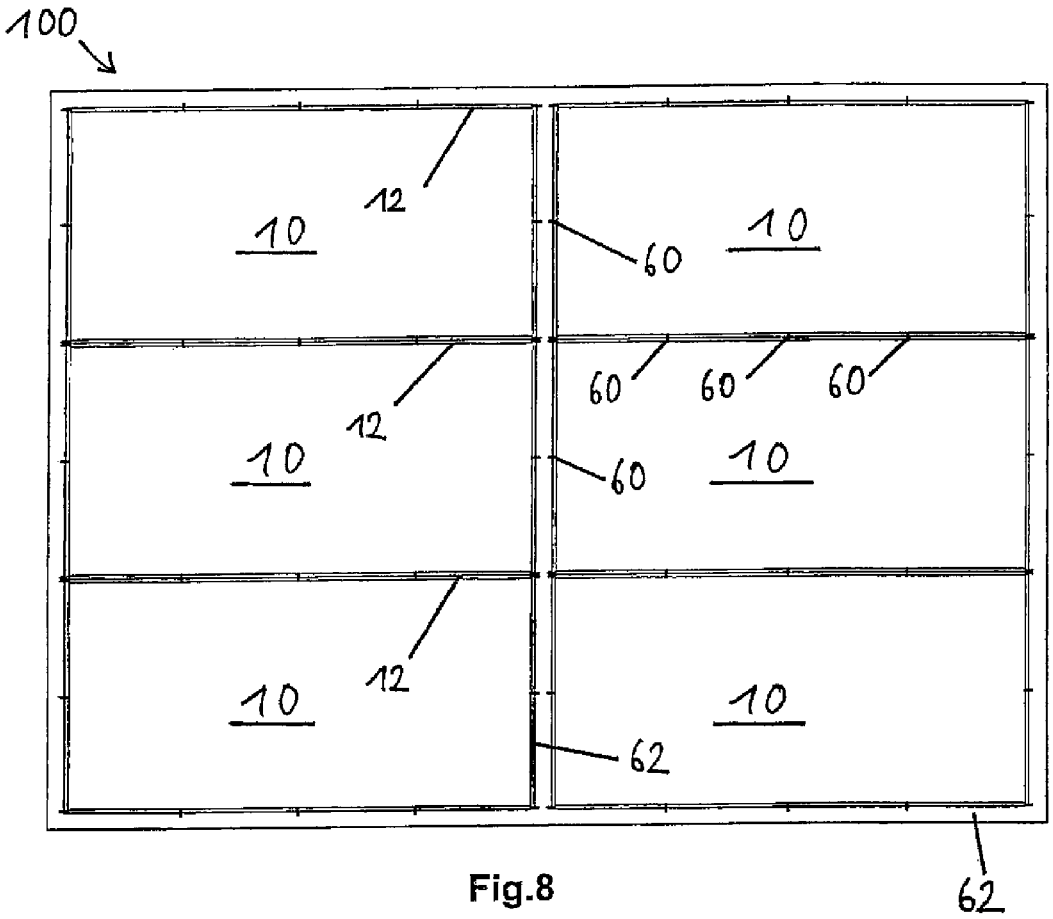
FIG. 8: shows an additional exemplary embodiment of a revetment of the invention comprising an edge profile.

An alternative variant for a revetment 100 is shown in FIG. 8. Here, in addition to the outer frame profiles 62, a supporting and/or frame profile 62 is provided at the center, which is likewise connected to the membrane elements 10 with the aid of tightening devices 60.

The general architecture of the membrane elements 10 will now be described with reference to FIGS. 1 to 5.

The membrane elements 10 consist of a stabilizing frame 12 and one or two membrane materials stretched over said frame.

Figure 2:
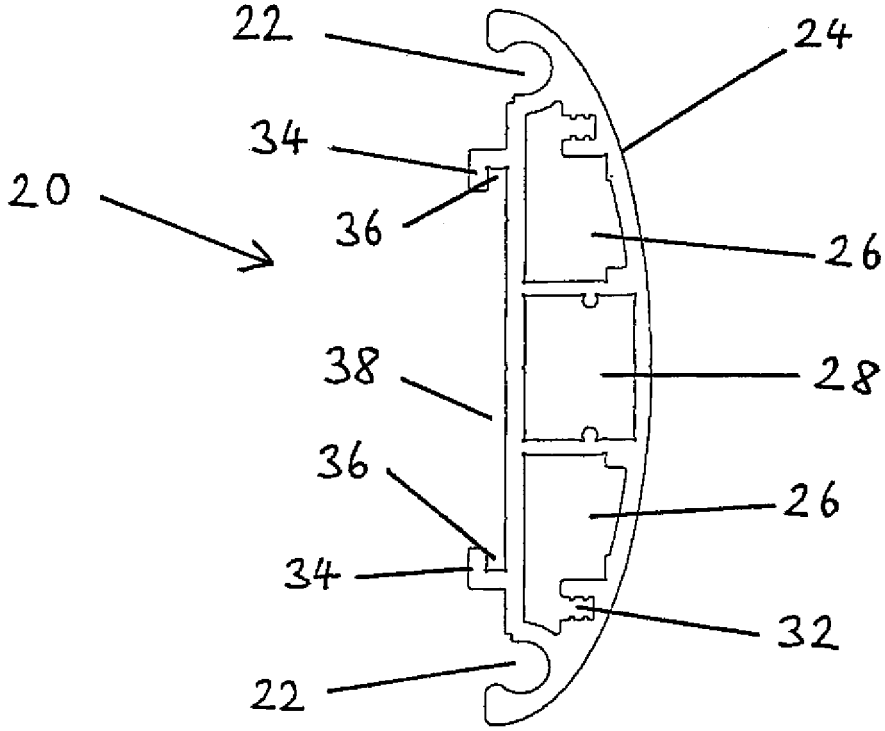
FIG. 2: is a sectional view of an exemplary embodiment of a frame profile for a membrane element of the invention.
Figure 3:
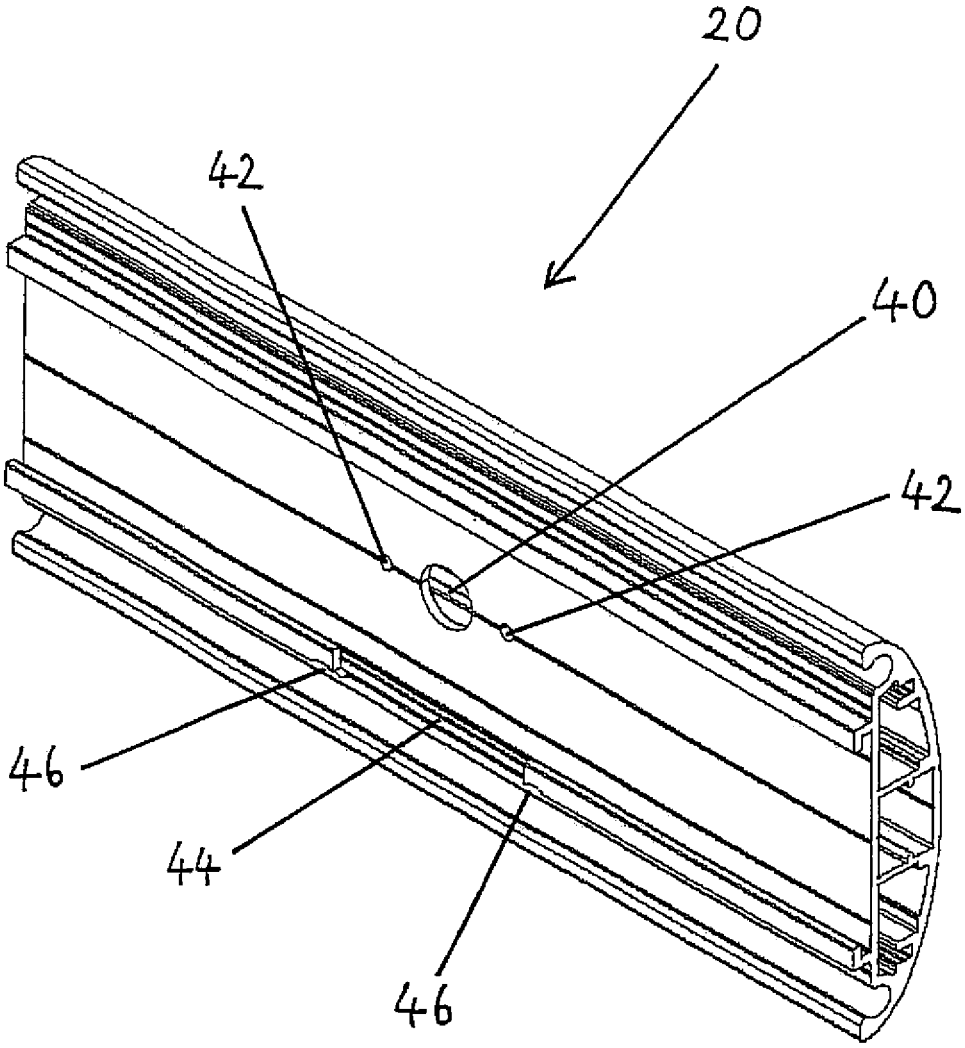
FIG. 3: is a partially cutout view of the frame profile shown in FIG. 2 comprising machined sections for accommodating the components of the tightening units.
Figure 4:
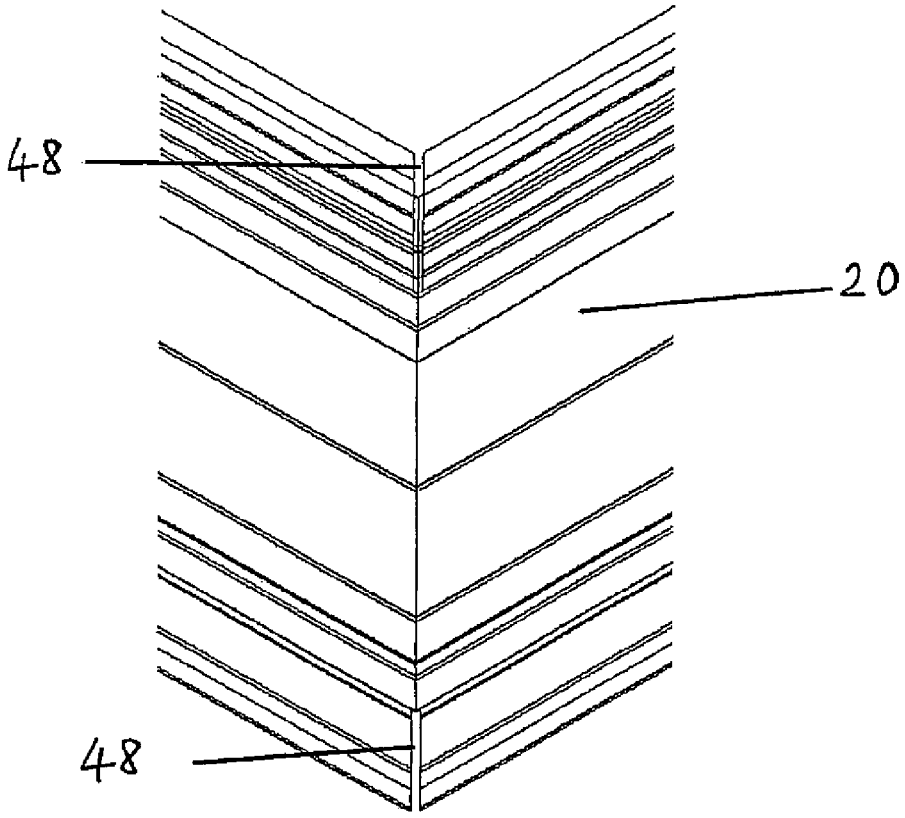
FIG. 4: is a perspective view of a corner region of a membrane element of the invention.

The frame 12 comprises thin semi-elliptical frame profiles 20 preferably made of extruded aluminum. FIG. 2 shows a sectional view of one such profile or frame profile 20. The frame 12 preferably has a rectangular or square shape. In principle, the frame 12 can have virtually any desired shape, in particular the shape of any desired polygon. As can be seen from FIGS. 6, 7, and 8, the frames 12 do not have additional reinforcing elements of any kind for transverse or longitudinal reinforcement.

The frame profile shown in FIG. 2 is preferably made of extruded aluminum, the ratio of profile height to profile width preferably ranging from approximately 4:1 to 5:1. The wall thickness in a profile 20 having a height of 80 millimeters is about 2 millimeters. All cavities, bores, and milled portions required for producing, mounting, and carrying out restoration of the membrane elements 10 are provided in the profile 20. The inwardly oriented side of the profile 20 has a semi-elliptical contour 24. Cavities 26 are provided in the upper and lower regions for the insertion of corner angular members. A cavity 28 is provided at the center for a slot nut, which is part of a tightening unit described in detail below. Recesses 32 serve to accommodate holding screws for an actuating tool which is to be used on the tightening units and is likewise described below. The upper and lower edge regions of that side of the profile 20 that faces outwardly in the assembled membrane element 10 of the invention are each provided with grooves 22 for a Keder or welt of membrane material, which is yet to be inserted. At points nearer the center, angular members 34 are formed which serve as stops for an adjacent profile. Between these angular members 34 there is a groove 38, in which a drive wheel for a tightening unit can be accommodated. In the region of the lower stop 34, milled slots 44 are additionally provided for the accommodation of the drive wheels of the tightening units. Furthermore, a central bore 40 is provided in the profile 20 for the passage of a tightening bolt into a slot nut, and bores 42 are further provided for securing the slot nuts with the aid of suitable pins.

The corners of the frame profiles 20 are miter-cut and connected to each other with the aid of angular members in the frame corners to be accommodated in the cavities 26 of the profile. A slot 48 is provided in each of the corner regions of the upper and lower sides of the profiles to allow for folding of overlapping membrane material 14 at the corners after the covering. This is shown diagrammatically in FIG. 4.

Figure 5:
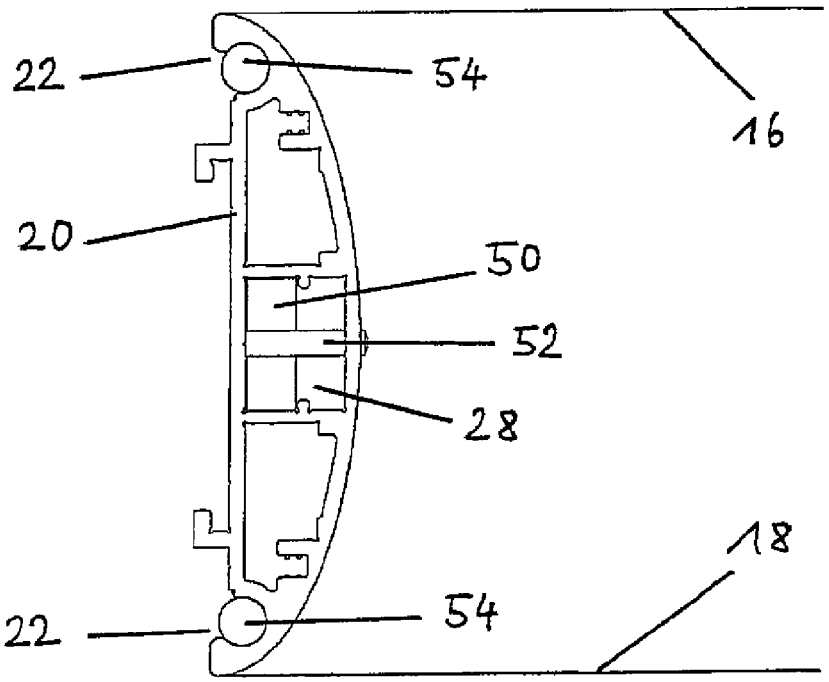
FIG. 5: shows the frame profile shown in FIG. 2 comprising attached membrane materials, Keders and slot nuts together with means for positively securing the same.

The fixation of the membrane materials on the profiles 20 is shown in FIG. 5. Here, a sealing membrane 16 is affixed to the upper side of the profile 20 with the aid of a welt 54 inserted into the groove 22 provided therefor in the profile 20. In the same way, a face membrane 18 is likewise affixed to the lower side with the aid of a welt 54 inserted into the lower groove 22 of the profile 20. FIG. 5 further shows a slot nut 50 which has been inserted into the cavity 28 and is secured therein with the aid of pins 52 that are retained in the holes 42.

The membrane materials used can be textile fabrics, films, and non-woven fabrics of all types depending on the application. The term "face membrane" refers to the membrane that is oriented toward the viewer, for example, inside a room and forms the visible boundary of the room. As shown in FIG. 5, a sealing membrane 16 can be disposed on the rear side of a frame 20, which sealing membrane 16 serves mainly to cover the interior of the membrane elements 10 and protect the same from pollution and the permeation of moisture. Furthermore, a sealing membrane 16 of such type can serve as a diffuser in the case of backlit membranes in order to considerably reduce, though not entirely prevent, the effect of the lamp and the shadows of dirt particles becoming visible. Films or coated fabrics are mainly suitable for a purely covering function. Preferably light scattering films, fabrics and non-woven fabrics are suitable for use as diffusers. Acoustically effective elements, for example sound absorbing elements, can preferably be realized by the use of a perforated face membrane.

In order to produce the membrane elements, the frame profiles 20 are first miter-cut according to the desired frame sizes and connected to form a frame 12 with the aid of angle profiles. The face membrane 18 and optionally the sealing membrane 16 are then stretched over the finished frame 12 to form smooth surfaces. The face membrane 18 and the sealing membrane 16 are connected to the frame profile 20, as shown in FIG. 5, by a clamp-connection by a welt 54 or a welt cord preferably made of a soft plastics material such as PVC or TPE or any other suitable material. In lieu thereof, a clamping strip or a clamping rail made of extruded aluminum may be used.

The initial tension in the membranes 16, 18 as builds up automatically when the membrane materials are stretched over the frames, produces an inward deformation of the thin frame profiles 20, as shown diagrammatically in FIG. 6. The degree of deformation is determined by the pre-tensioning forces introduced and is precisely defined. This deformation is intentional and forms part of the assembly concept described below.

According to the invention, means are provided for re-tightening the frames deformed as a result of the membrane pre-tension so as to return them to the originally non-deformed state with the aid of special tightening mechanisms. For this purpose, the adjacent membrane elements 10 or, depending on the arrangement used, a suitable edge profile 62 can serve as the abutment in preferred variants. The membrane pre-tensioning forces are thus counter-balanced and neutralized. After being re-tightened, the frame is restored to its original shape prior to being covered with the membrane material. This is apparent from FIGS. 7 and 8. The membrane elements 10 can be arranged in different ways. In a first variant shown in FIGS. 6 and 7, an edge profile 62 surrounds an entire array of a plurality of membrane elements 10. The edge profile 62 serves as an abutment to absorb the tension forces of the membrane elements 10 at the edges of the array. At the same time, the edge profile 62 can also serve as a terminating element or a connecting element for joining one array of membrane elements to an adjacent construction. The edge profile 62 is also preferably produced from commercially available aluminum profiles or canted aluminum or steel sheeting.

Figure 9:
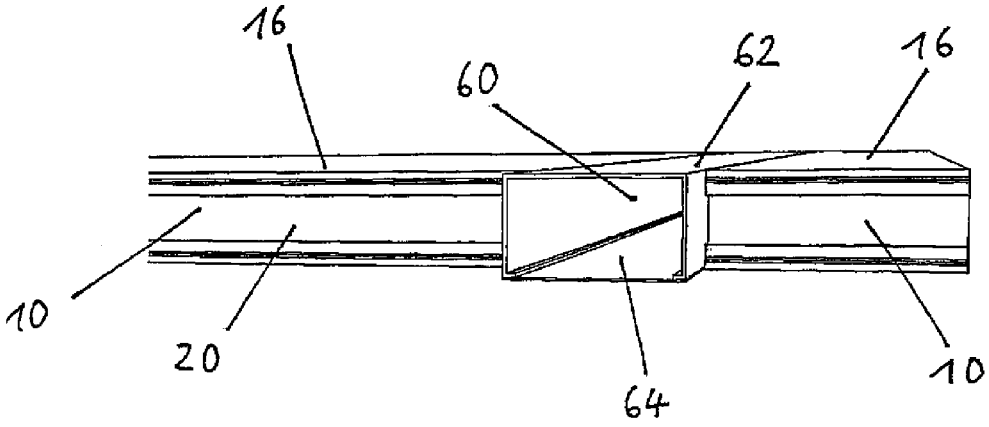
FIG. 9: is a detailed view of the connection of the membrane elements to the edge profile.

In the second embodiment shown diagrammatically in FIGS. 8 and 9, a supporting profile 62 is additionally provided in the inner region of the overall revetment, which supporting profile can have a U-shape, for example, and is advantageously also made of aluminum. This inner edge profile 62 can serve for accommodating and routing of installation-wirings such as cable looms and water pipes and the integration of sprinkler systems and other technical building installations. It may be advantageous, for this purpose, to provide the channel with a cover 64. The edge profile 62 here mainly performs the function of absorbing the tension forces of the adjacent membrane elements 10. Furthermore, this edge profile can also accommodate hinge bolts for pivoting the membrane elements 10, as is described below in detail.

The tightening mechanism and the tightening method will now be explained with reference to FIGS. 10 to 21.

The tightening units 60, with the aid of which the pre-tensioning forces of the membrane material 14 are counter-balanced, substantially comprise a threaded bolt or tightening bolt 80, a drive wheel 70 and a slot nut to be inserted into the edge profiles 20. A tightening bolt 80, a drive wheel 70, and two slot nuts 50 having female threads form a tightening unit 60. The number of tightening units per unit length or per frame side is governed by the tension forces and the flexural rigidity of the frame profiles 20.

The slot nuts 50 have a thread, into which the tightening bolts 80 can be screwed. The slot nuts 50 are inserted into the cavities 28 of the frame profile 20, pushed into the correct position and positively secured in position therein on the left and right sides, for example by means of simple metal pins. The slot nuts are preferably mounted with a certain degree of play, which facilitates screwing thereof into the tightening bolt 80. The slot nuts are preferably made of galvanized steel.

The membrane elements 10 are pulled together with the aid of the tightening bolts 80, by virtue of which the pre-tensioning forces of the membrane elements 10 are counter-balanced and the inwardly bent frame regions 56 of the membrane element 10 are again aligned parallel to each other. A tightening bolt 80, which is produced in a manner known per se, is shown diagrammatically in FIG. 12. At one end, the tightening bolt 80 has a stop 82, which prevents the drive wheel 70, described below, from slipping or falling out. Away from this end, the tightening bolt 80 has a flattened region 86, this being a flat cut of a male thread 84 adapted to engage the slot nuts 50. The tightening bolt 80 then merges via a taper 88 into a tapered region 87, the axial length and radial thickness of which are such that this tapered region 87 can freely pass through the opening in the slot nuts 50. This functionality is explained in more detail below. Finally, the end of the tightening bolt 80 is terminated by a cap nut 89, which is screwed onto a thread not shown in FIG. 12 and serves as a stop for a slot nut 50.

Figure 10:
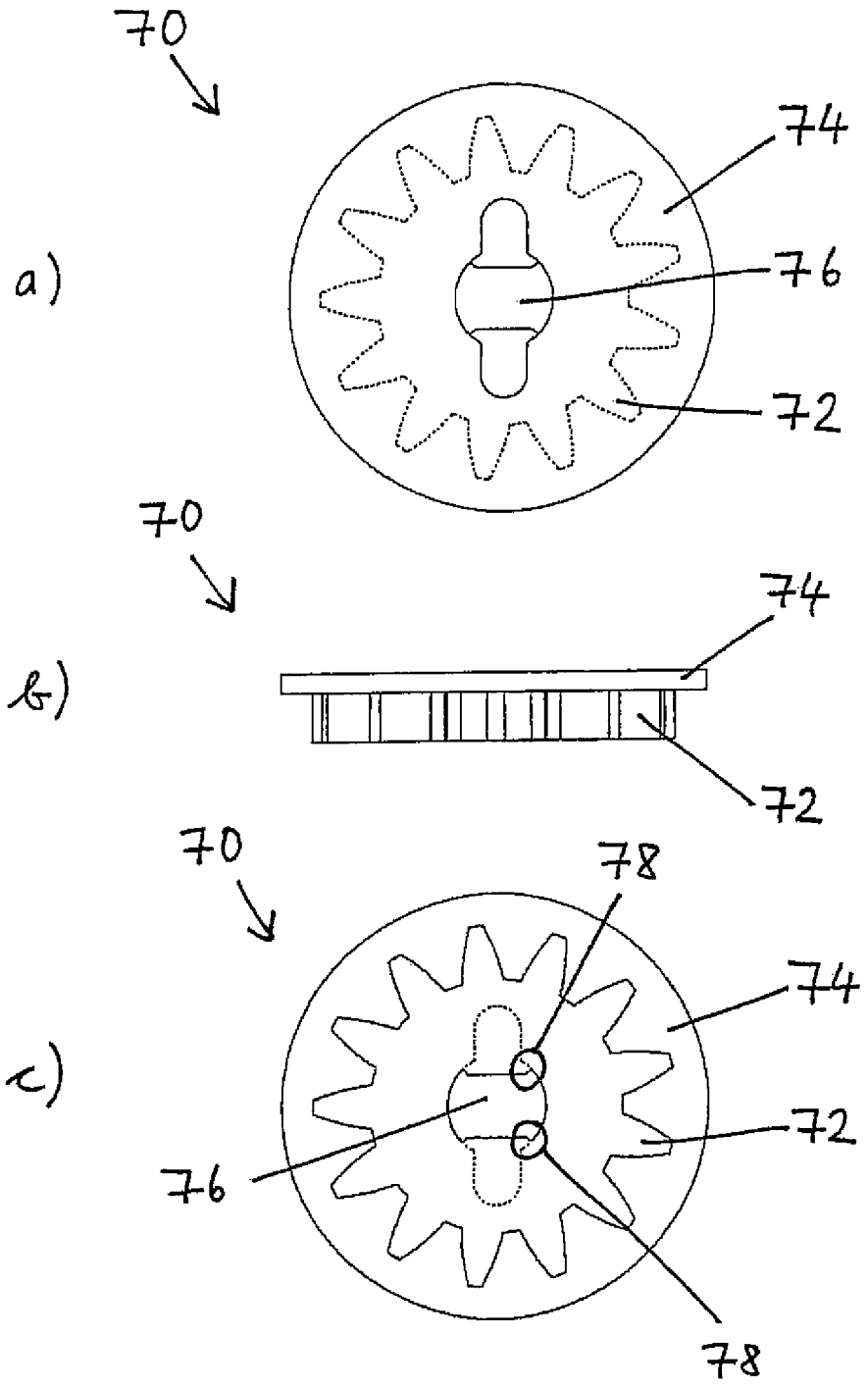
FIG. 10: shows several views of a drive wheel for a tightening unit.

The structure of a drive wheel 70 and its cooperation with the tightening bolt 80 and the edge profile 20 will now be described with reference to FIGS. 10 to 14. The drive wheel 70, the front view of which is shown in FIG. 10*a*), the side view of which is shown in FIG. 10*b*), and the rear view of which is shown in FIG. 10*c*), comprises, as its main components, a circular disk-shaped plate 74, a toothed wheel 72, which is attached thereto or integrally molded therewith and which serves to drive the drive wheel, and an opening 76 for a tightening bolt 80 to pass therethrough. One special feature of this opening 76, as shown in FIG. 10*c*), is that the corner regions thereof are each provided with a carefully designed recess 78, which prevents damage to the thread of the tightening bolt 18.

Figure 13:
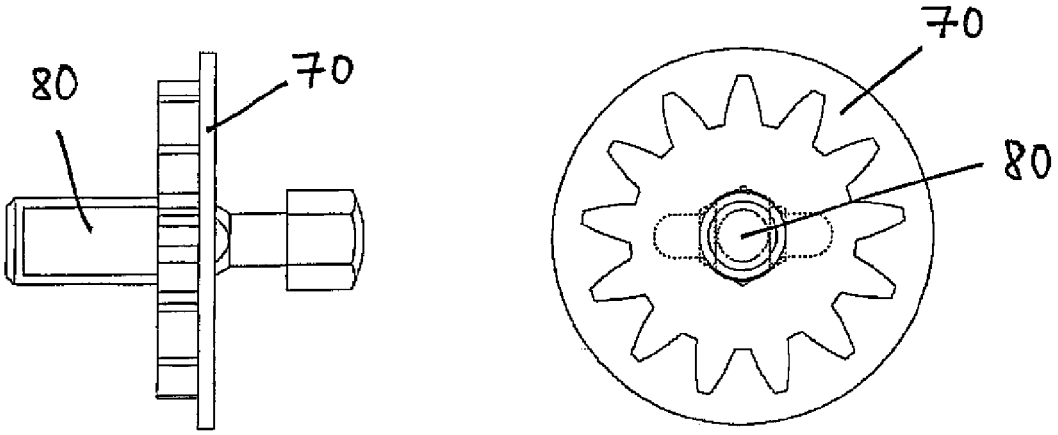
FIGS. 13 and 14: show the positioning of the tightening bolt shown in FIG. 12 in the drive wheel shown in FIG. 10.
Figure 14:
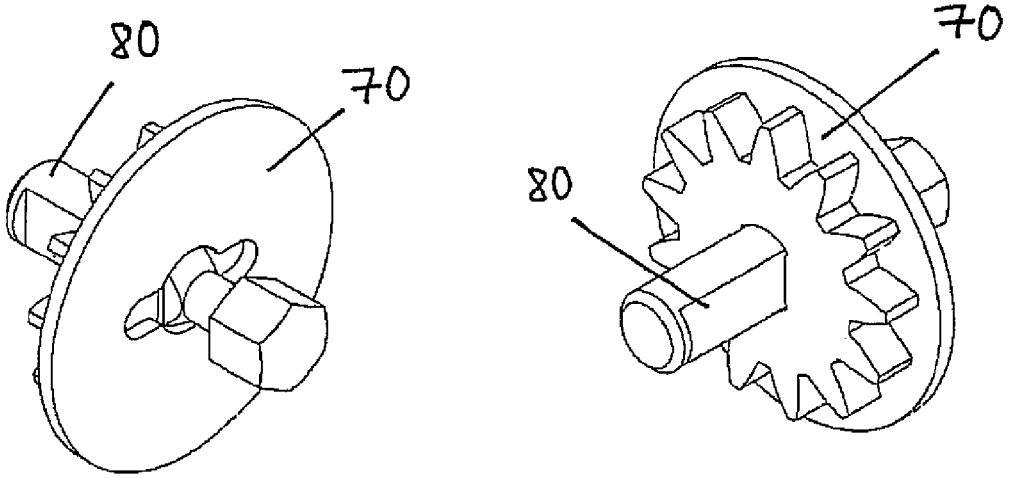

The position of the drive wheel 70 relative to the frame profile 20 is shown in FIGS. 11*a*) and 11*b*). An edge region of the plate 74 engages in a groove 36 behind the angular stop members 34 of the frame profile and is in this way secured from falling out, see FIG. 2. Furthermore, FIG. 11*b*) shows the manner in which the drive wheel 70 is positioned centrally in relation to the recess 44 so that this recess 44 allows for access to the drive wheel 70 by a tool, which is described below. In the example illustrated, a toothed wheel 72 is used for driving the drive wheel 70. The drive wheel 70 is preferably made of stainless steel. The drive wheel 70 has, at its center, an opening 76 matching the flattened region 86 of the tightening bolt 80 and is pushed over the latter, as shown in FIGS. 13 and 14. When the drive wheel 70 is rotated, the torque is transferred via the opening 76 to the tightening bolt 80. The engagement of the plate 74 in the groove 36 behind the angular stop members 34 of the frame profile, see FIG. 2, additionally prevents the drive wheel 70 from moving back and forth on the tightening bolt in an uncontrolled manner. A turning tool described in detail below is used for turning the drive wheel 70.

Figure 11:
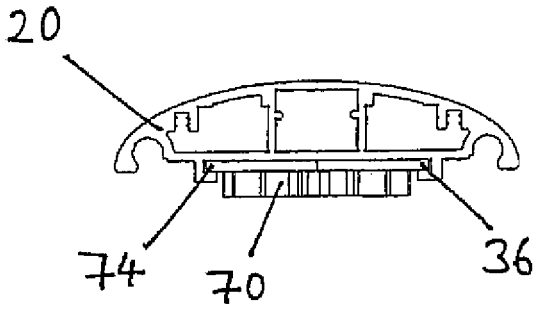
FIG. 11: shows the arrangement of the drive wheel shown in FIG. 10 in the frame profile shown in FIG. 2.
Figure 11:
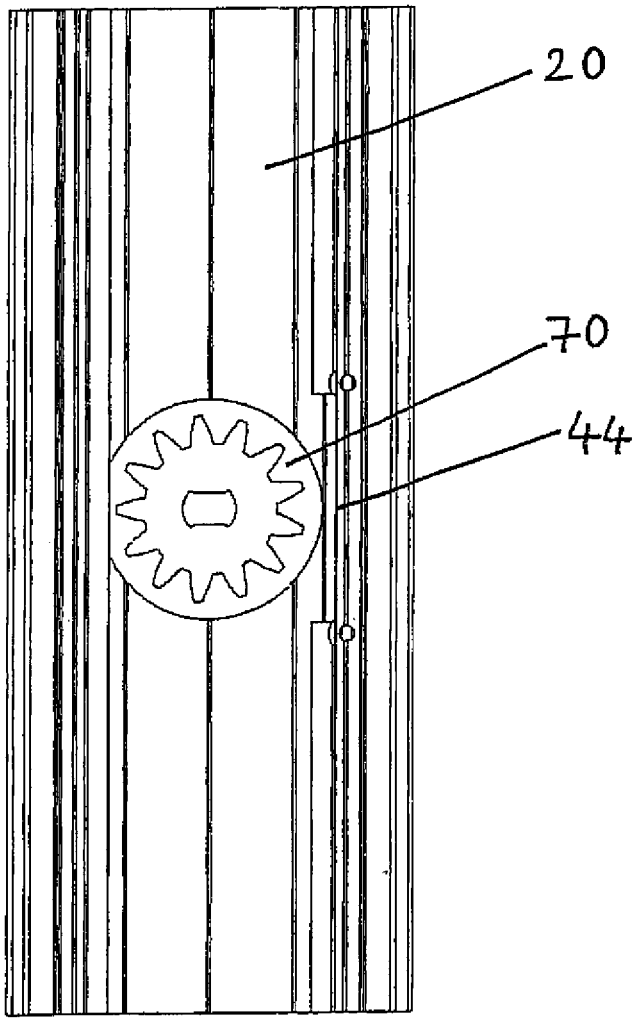
Figure 12:
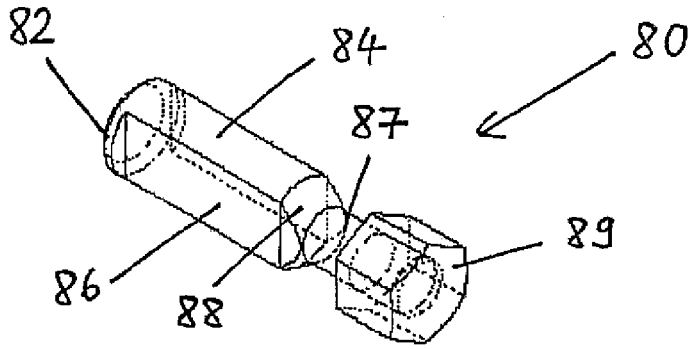
FIG. 12: is a perspective view of a tightening bolt for a tightening unit.
Figure 15:
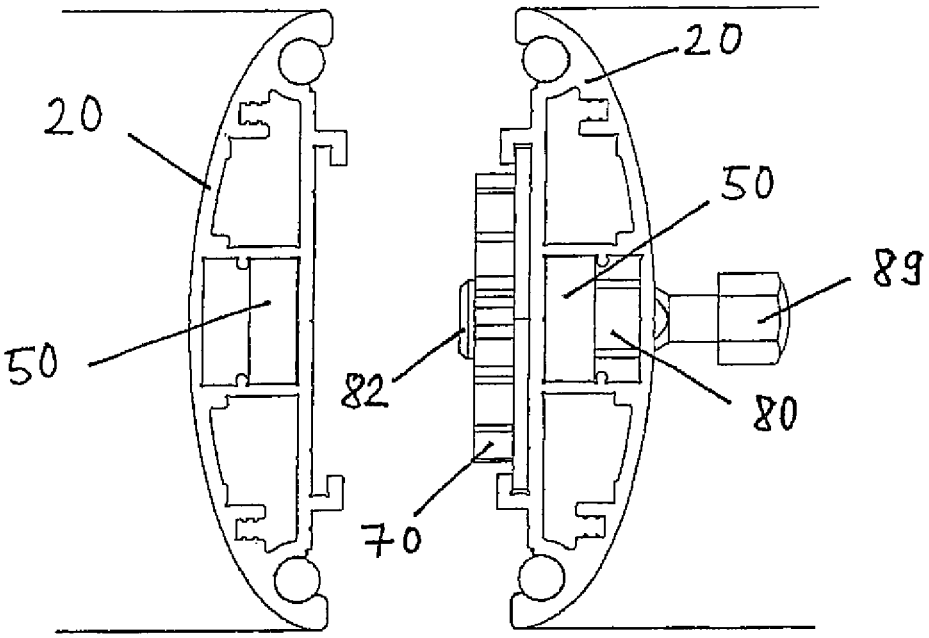
FIGS. 15 and 16: show a first method variant for tightening adjacent frame regions together.

When carrying out the tightening procedure, the drive wheel 70 is positioned in front of the slot nut 50 on the frame profile 20, as shown in FIG. 11. A tightening bolt 80 is then inserted through the drive wheel 70 and screwed forward into the slot nut 50 disposed inside the frame profile 20 until the stop 82 prevents further screwing. This situation is shown in FIG. 15. The stop 82 serves to hold the tightening bolt 80 when the membrane elements are loosened and to keep it from accidentally falling into the interior of the membrane element. A cap nut 89, which is then screwed on from the rear onto that end of the tightening bolt 80 that is provided with a smaller thread, and is secured, for example adhesively, from undesired loosening. This cap nut 89 serves as the rear stop.

A first method of tightening the frame profiles together will now be described with reference to FIGS. 15 and 16. After establishing the initial state shown in FIG. 15, the regions of the frame that are to be connected are pressed together, for example with the aid of suitable pliers, such that the threaded part 84 of the tightening bolt 80 can be screwed into the slot nut 50 of the adjacent membrane element 10 with the aid of the drive wheel 70 activated by a turning tool. The pliers used for pressing the opposing frame regions together can, in particular, engage in the groove 36 of the profiles 20—see FIG. 3. When the tightening bolt 80 has been turned far enough through the slot nut of the right-hand frame profile 20 in FIG.

Figure 16:
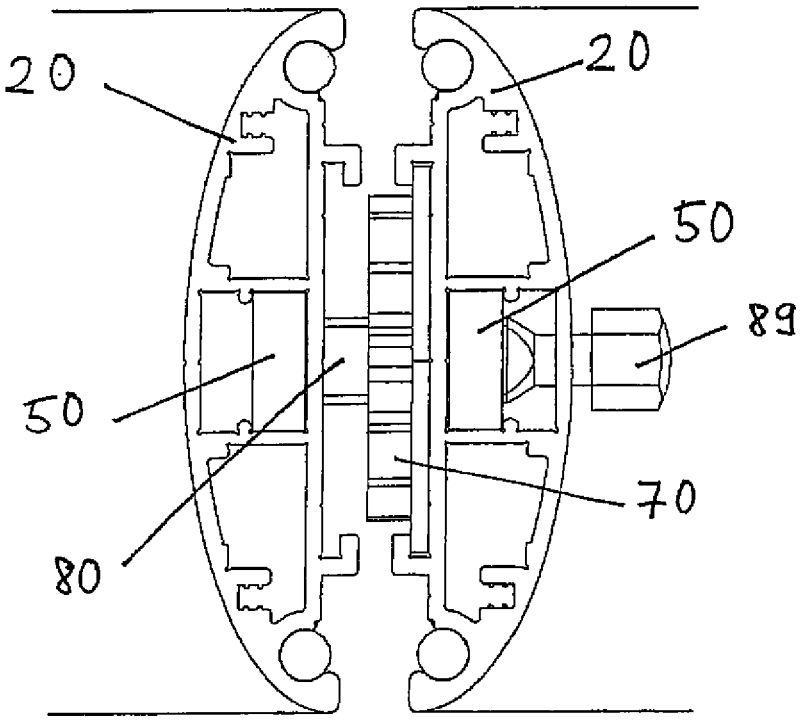

16, there is no longer any thread engagement between the slot nut 50 and the tightening bolt 80 so that the tightening bolt 80, when turned further, is held only by the thread of the slot nut 50 of the left-hand frame profile 20 in FIG. 16. When the tightening bolt has been screwed in far enough, the cap nut 89 will bear against the slot nut 50 of the right-hand frame profile 20 in FIG. 16 and further turning of the tightening bolt 80 will bring the frame profiles 20 to be connected closer together.

Figure 17:
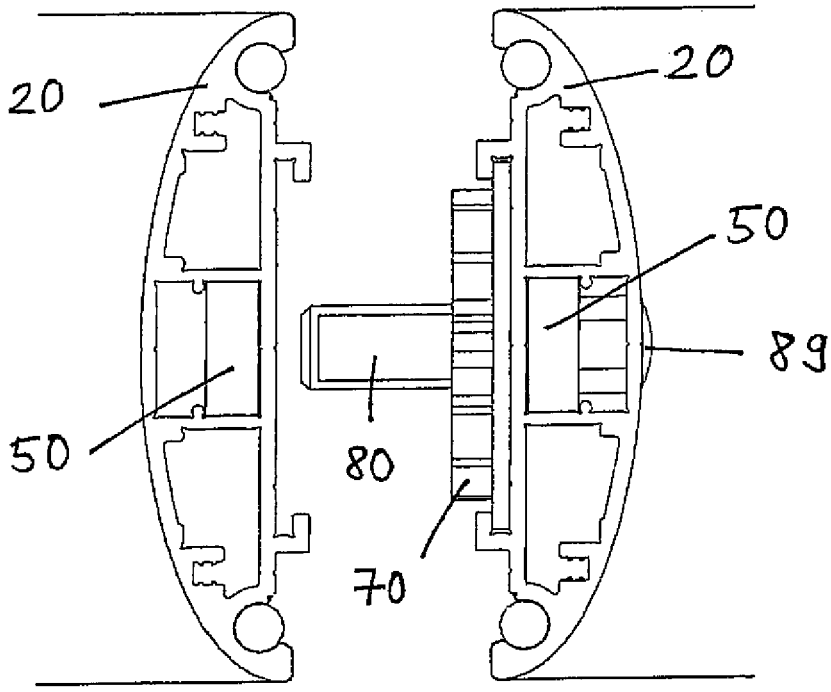
FIGS. 17 and 18: show a second method variant for tightening adjacent frame regions together.
Figure 18:
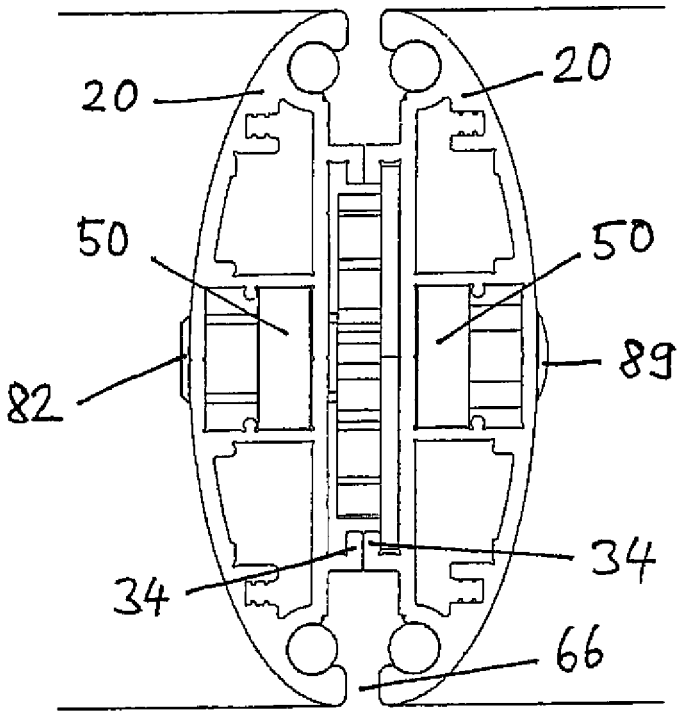

Alternatively, the tightening bolt 80 can be unscrewed from the right-hand profile 20 with the help of the turning tool, already at the commencement of the tightening procedure, until stopped at the rear, that is to say, until the cap nut 89 comes into contact with the slot nut 50. This is shown in FIG. 17. The left-hand profile in FIG. 17 is then brought close to the tightening bolt 80 with the aid of pliers and the profiles can then be screwed together. Lastly, the final state, shown in FIG. 18, is achieved in both variants, in which the profiles 20 are in contact with each other via their angular stop members 34 and have consequently reached their end position. It is further apparent from FIG. 18 that between the frame profiles 20 there exists a gap 66, through which access to the toothed wheel 72 of the drive wheel 70 is made possible.

Figure 19:
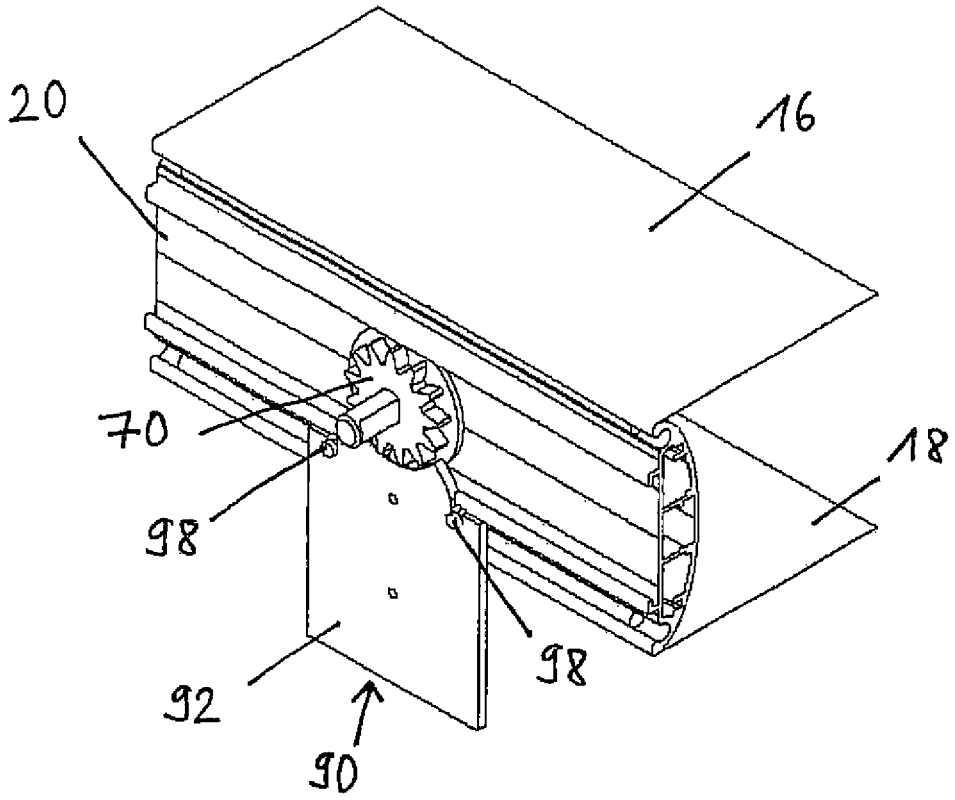
FIGS. 19 to 21: show the mode of operation of a tool for actuating the tightening units.
Figure 20:
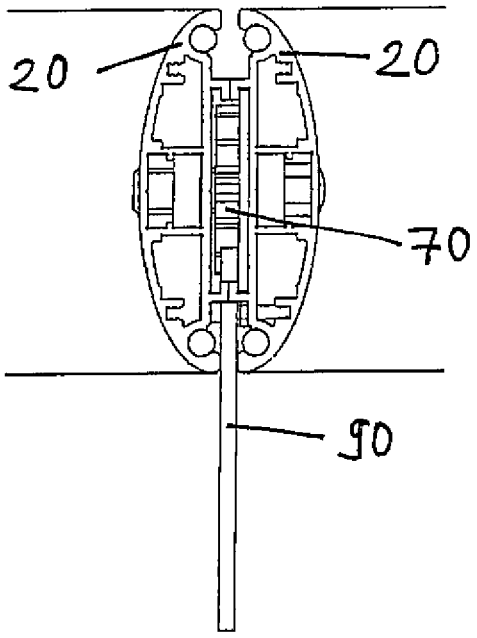
Figure 21:
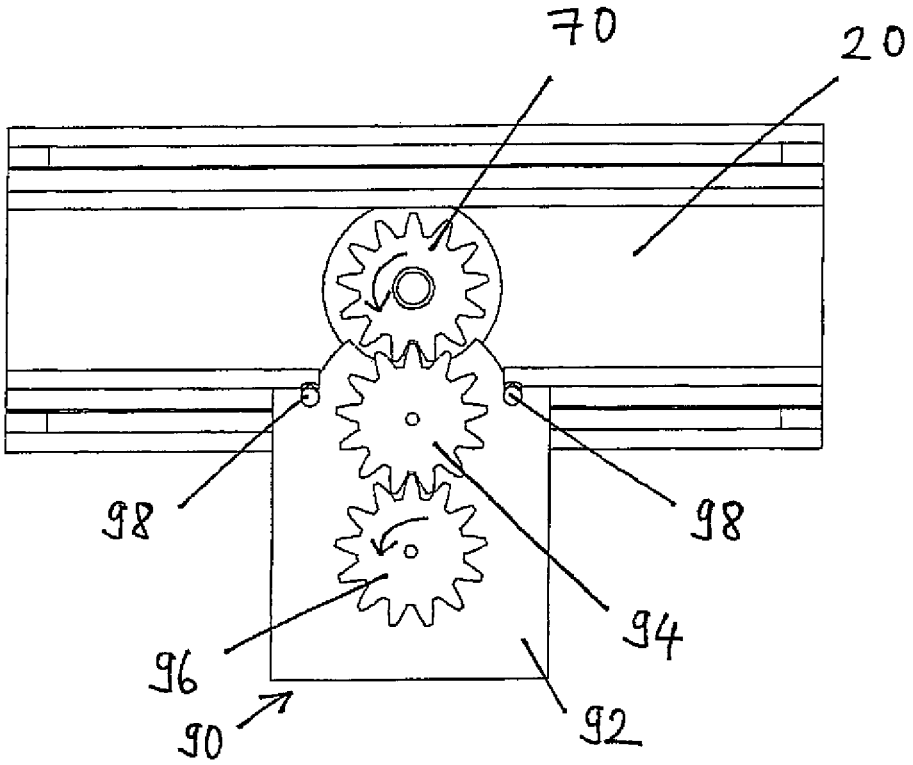
Figure 22:
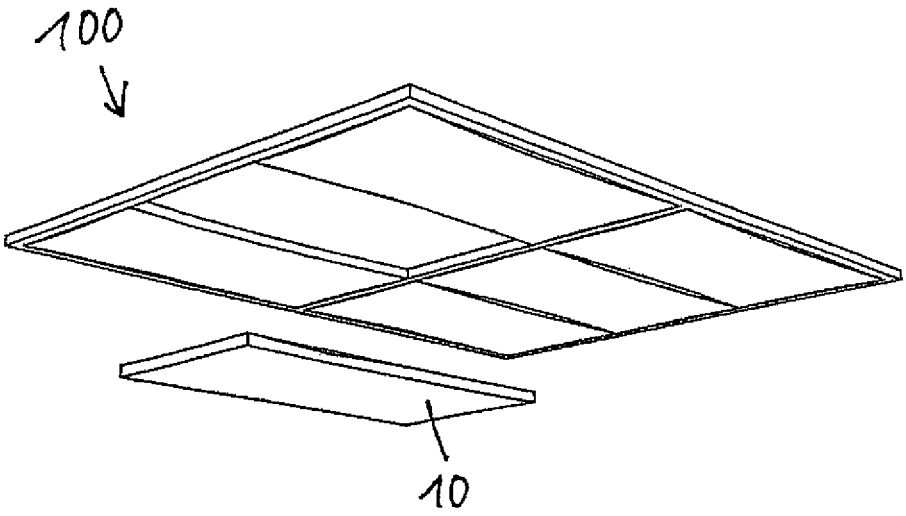
FIGS. 22 to 27: show variants for removing or swiveling out membrane elements for maintenance and/or cleaning purposes.

This will now be explained with reference to FIGS. 19 to 21, in which an actuating tool is shown diagrammatically and is provided with the reference numeral 90. The actuating tool substantially consists of a plate 92, on which, in the example illustrated, two additional toothed wheels 94, 96 are mounted for rotation, with the aid of which the toothed wheel 72 of the drive wheel 70 for the tightening bolt 80 can be rotated. For this purpose, the tool 90 engages through the recess 44 provided in the profile 20 and is accurately positioned with the aid of screws 98 screwed into bores 46, see FIG. 3, by virtue of which all additional forces occurring when turning the tightening bolt 80 are absorbed by the frame profile 20. This advantageously enables the operator to work in a force-free and thus comfortable manner. The toothed wheels are preferably turned with the aid of a motor, such as an electric motor for example.

An alternative example of a tightening unit is indicated diagrammatically in FIG. 29. Here, opposing frame profiles 20 are held together with the aid of a tightening piece 68 having an H-shaped profile. This profile can be inserted between the frame profiles 20, for example through recesses provided at an appropriate place. Possibly, U-shaped profiles could be fitted on the outside along outwardly oriented angular members similar to the inwardly oriented angular members 34.

Restoration, cleaning, and accessibility of the revetment of the invention and of the membrane elements of the invention will now be explained with reference to FIGS. 22 to 27. The term "restoration" is to be understood to mean mainly the cleaning and maintenance of the upper and lower membrane surfaces or of the materials used, respectively, as well as of the seams between the membrane elements 10. The restoration of the membrane elements 10 or lamps possibly located behind the same can be carried out in different ways. In a first variant, the individual membrane elements 10 can, due to the special assembly system implemented by the tightening units 60, be removed independently of each other and, on account of their low weight, be disassembled, for example, by two persons. This is shown diagrammatically in FIG. 22. This membrane element 10 can then be cleaned, replaced or modified in any other way possible, as desired.

Figure 23:
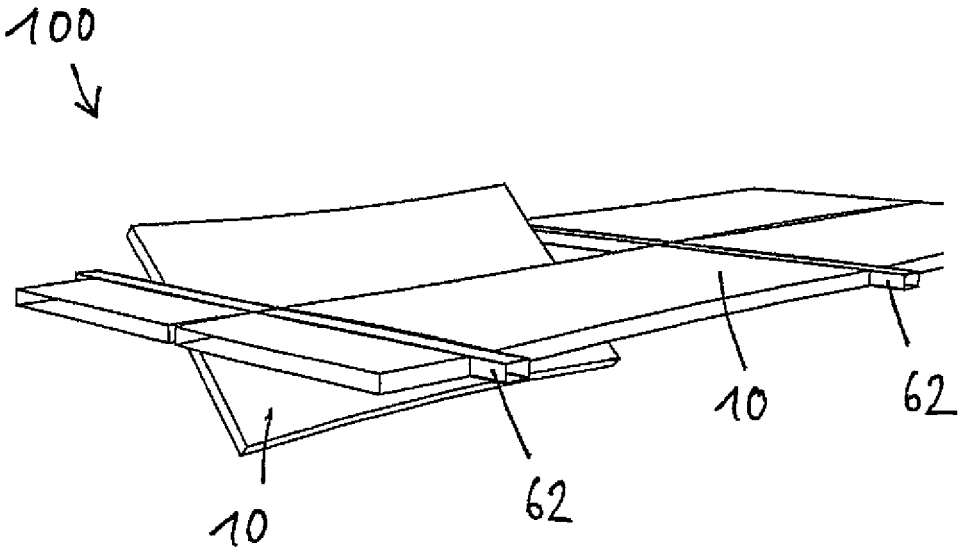
Figure 24:
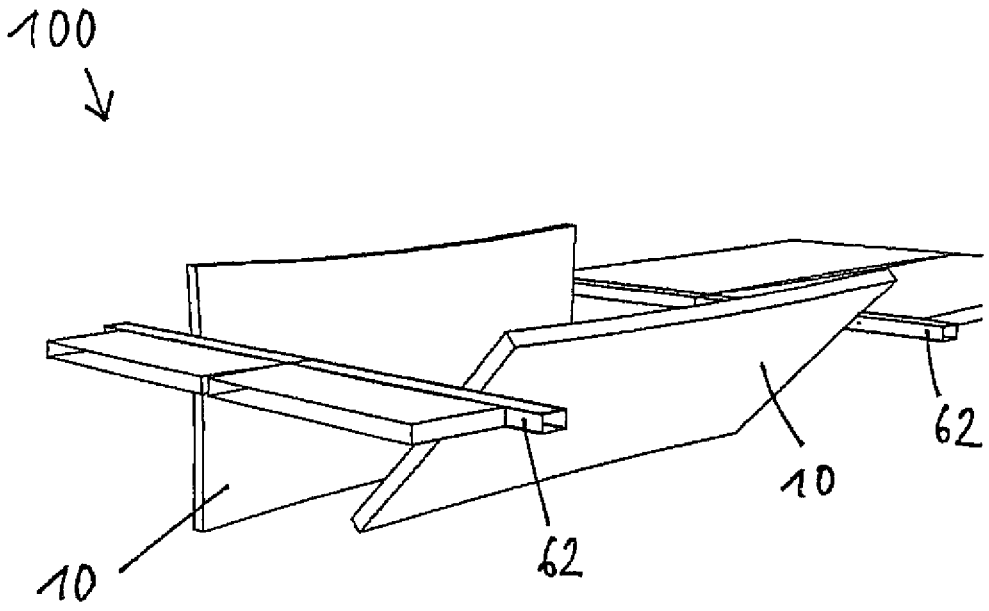
Figure 25:
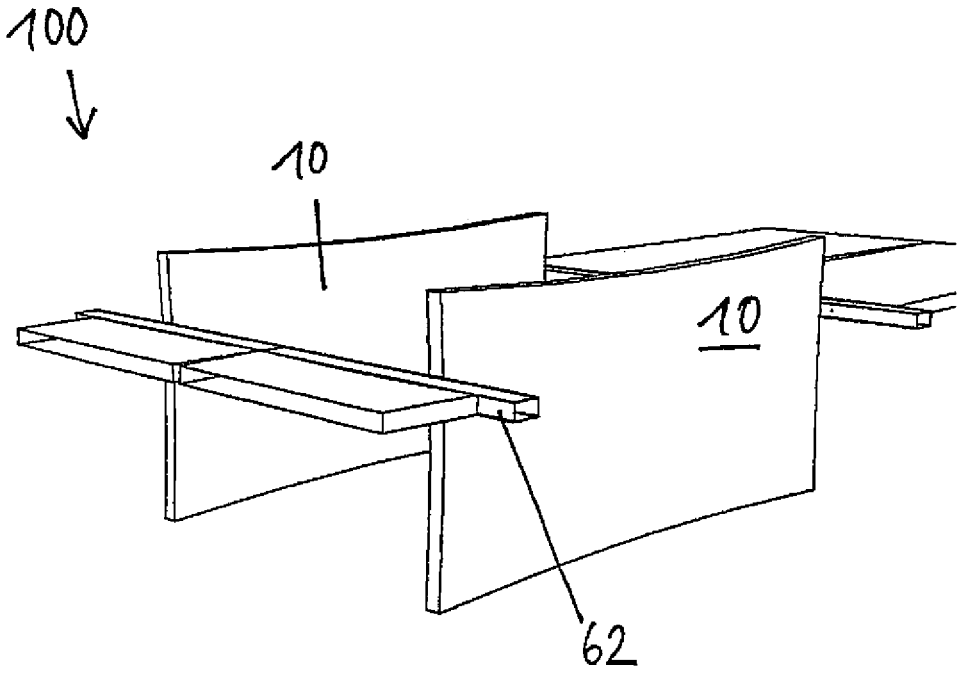

In a second variant shown diagrammatically in FIGS. 23 to 27, the membrane elements 10 can be swiveled about tightening bolts 80 or hinge pins provided specifically for this purpose. The hinge pins can be provided, for example, between the membrane elements 10 and edge profiles 62. All other tightening units 60 are undone before the membrane element 10 is swiveled. A swiveling procedure, in which the axis of rotation is located at approximately a quarter of the short side of a membrane element 10, is shown in FIGS. 23 to 25. Here, after swiveling, a portion of the membrane elements 10 is located above the edge profiles 62. The membrane element 10 is thus swiveled about the pin axis and then moved into an opening position. The location of the pivot axis and the direction of swiveling are governed by the space available on site and the individual requests of the client or architect.

Figure 26:
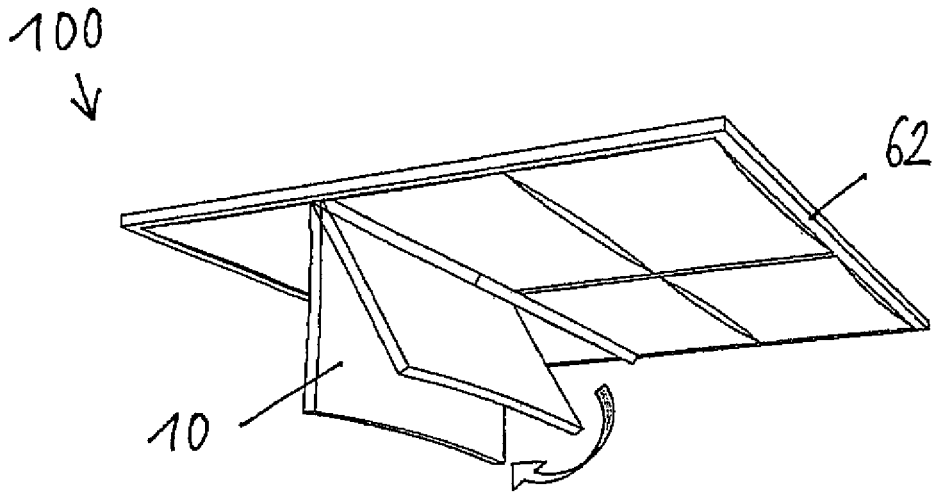
Figure 27:
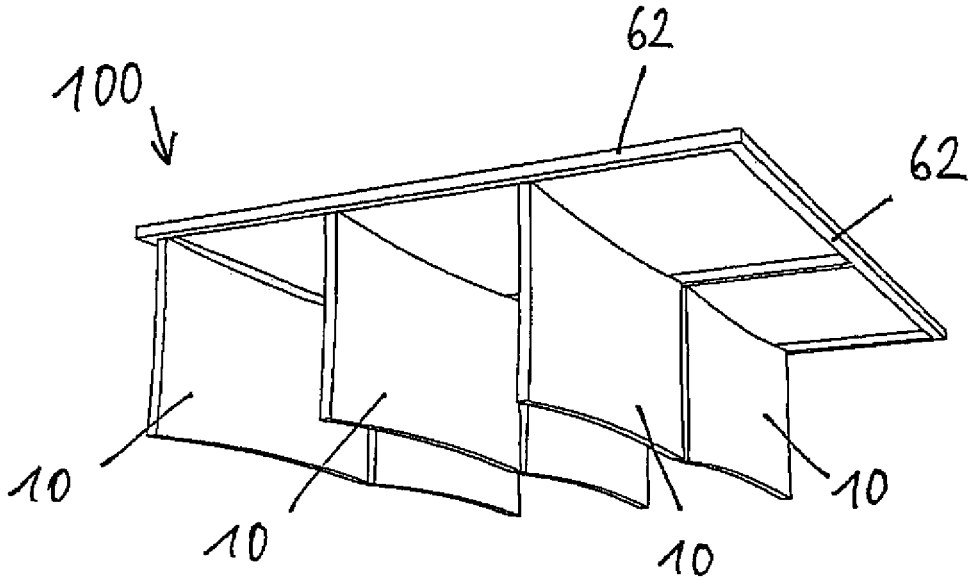
Figure 28:
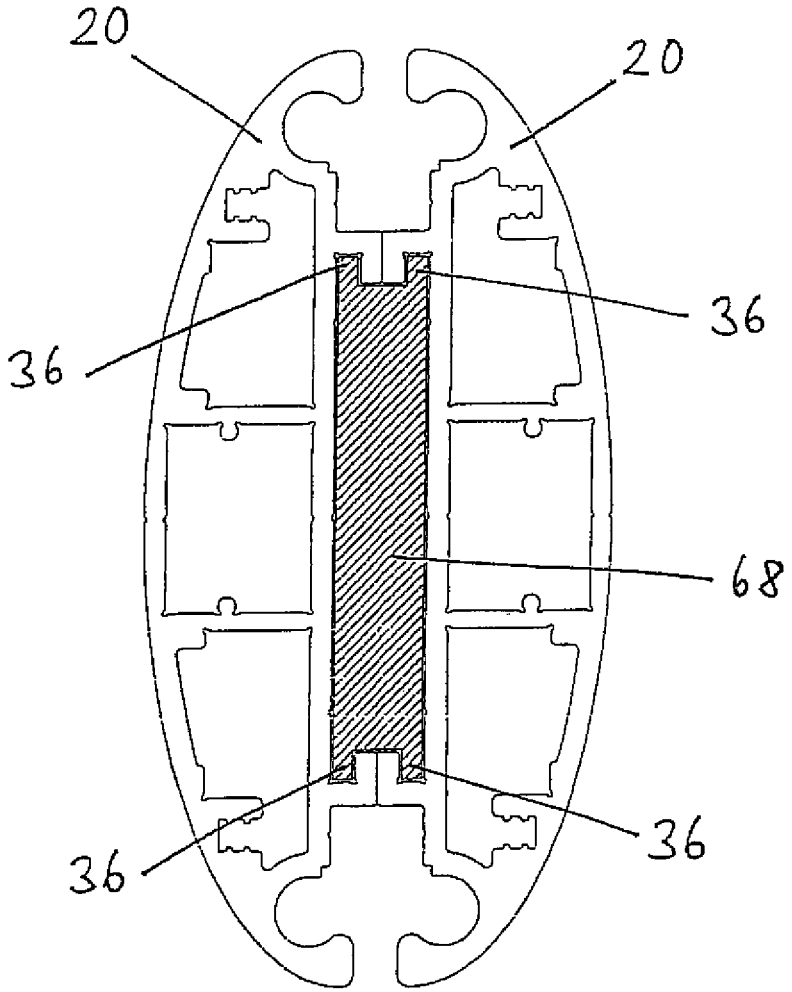
FIG. 28: shows an alternative exemplary embodiment of a tightening unit.

For example, in the variant shown in FIGS. 26 and 27, the pivot axis is located in a corner region of the membrane elements and the latter are swiveled downwardly about their long sides. FIG. 26 shows the various stages of the way of swiveling an individual membrane element. FIG. 27 shows a situation referring to a total of six downwardly swiveled membrane elements 10 in a revetment 100 of the invention.

The features mentioned herein also permit easy and rapid accessibility to parts of the building and installed components such as lighting systems and other installations disposed behind the membrane elements.

The present invention provides a novel membrane element and a novel method for covering surfaces, which both allow for the supporting structures to be designed with a much thinner configuration and thus for considerable advantages to be achieved in terms of material usage and possible configurations.

The invention claimed is:

1. A membrane element for covering surfaces, comprising a frame and a membrane material stretched thereon, wherein at least one frame region is bent inwardly on account of forces exerted by said membrane material on said frame, wherein the inwardly bent frame region has at least one tightening unit for pulling or pressing said frame region outwardly with respect to an abutment, towards an unbent state and wherein each tightening unit includes a bolted joint to pull bent frame regions toward said abutment, wherein slot nuts are fixed in said frame for said bolted joint, wherein a threaded bolt is present for bolting said slot nuts together, the threaded bolt including a shaft with a pair of opposing threaded side regions and a pair of opposing flattened side regions, wherein the pair of opposing threaded regions are separated from each other by the pair of opposing flattened side regions, and wherein a driving wheel is present in said frame for rotating the threaded bolt to displace the slotted nuts relative to one another, the driving wheel including: a circular disk-shaped plate having an edge region that is rotatably engaged in the frame, a toothed wheel connected to the circular disk-shaped plate, and an opening in the disk-shaped plate and the toothed wheel for receiving the threaded bolt therethrough, the opening having a shape matching the flattened side regions of the shaft of the threaded bolt, such that a rotation of the driving wheel results in a corresponding rotation of the threaded bolt.

2. The membrane element as defined in claim 1, which is designed for covering at least one of ceilings and walls.

3. The membrane element as defined in claim 1, wherein said threaded bolt is present for bolting said slot nuts together in adjacent frame regions.

4. The membrane element as defined in claim 1, wherein said membrane material is one of a film, a coated fabric, a light-scattering film, and a non-woven fabric.

5. The membrane element as defined in claim 1, wherein said frame is covered on a plurality of sides.

6. The membrane element as defined in claim 5, wherein said membrane material on the first side is a light-scattering material and said membrane material on a second side is a translucent material.

7. The membrane element as defined in claim 1, wherein said membrane material is fixed to the frame by means of a Keder joint.

8. The membrane element as defined claim 1, wherein said frame is composed of aluminum profiles.

9. The membrane element as defined claim 1, wherein said frame is composed of aluminum profiles with a semi-elliptical cross-section.

10. The membrane element as defined in claim 1, wherein said threaded bolt has a first thread at a first end, the first thread comprising the pair of opposing threaded side regions, and a second thread at a second end.

11. The membrane element as defined in claim 1, wherein said slot nuts are accommodated in the frame with a degree of play.

12. The membrane element as defined in claim 1, wherein said threaded bolt has a tapered region for passage through said slot nut, a rear stop member as a displacement guard against said driving wheel and a front stop member as a displacement guard against said slot nuts.

13. The membrane element as defined in claim 1, wherein in the region of each tightening unit a recess is formed in the frame to allow for access to the tightening unit with a tool, and wherein the tool is configured to rotate the driving wheel.

14. The membrane element as defined in claim 13, wherein stop means are provided in said frame in the region of said recess for defined positioning of said tool.

15. The membrane element as defined in claim 13, wherein screws are provided in said frame in the region of said recess for defined positioning of said tool.

16. The membrane element as defined in claim 13, wherein the tool comprises at least one toothed wheel for rotating the toothed wheel of the driving wheel.

17. The membrane element as defined in claim 16, wherein the tool comprises a plate and at least two toothed wheels rotatably mounted on the plate.

18. The membrane element as defined in claim 17, further comprising a plurality of protruding members within the recess in the frame, wherein the plate is positioned in the recess using the protruding members such that one of the toothed wheels mounted on the plate engages the toothed wheel of the driving wheel.

19. The membrane element as defined in claim 1, further comprising clamp-connections for securing said membrane material on said frame.

20. The membrane element as defined in claim 19, wherein said clamp-connections are in the form of separate clamping elements, which can be attached to said frame.

21. The membrane element as defined in claim 19, wherein said clamp-connections are in the form of separate clamping elements, which can be attached to said frame and are displaceable.

22. The membrane element as defined in claim 1, wherein the slot nuts are secured in position in cavities in the frame.

23. The membrane element as defined in claim 1, wherein the edge region of the circular disk-shaped plate of the drive wheel is rotatably engaged in a groove formed in the frame.

24. The membrane element as defined in claim 1, wherein each tightening unit is positioned at a location where bending occurs on the inwardly bent frame region.

25. A revetment for surfaces, comprising a plurality of membrane elements for covering surfaces, each membrane element comprising a frame and a membrane material stretched thereon, wherein at least one frame region is bent inwardly on account of forces exerted by said membrane material on said frame, wherein the inwardly bent frame region has tightening units for pulling or pressing said frame region outwardly with respect to an abutment, towards the unbent state and wherein each tightening unit includes a bolted joint to pull bent frame regions toward said abutment, wherein slot nuts are fixed in said frame for said bolted joint, wherein a threaded bolt is present for bolting said slot nuts together, the threaded bolt including a shaft with a pair of opposing threaded side regions and a pair of opposing flattened side regions, wherein the pair of opposing threaded regions are separated from each other by the pair of opposing flattened side regions, and wherein a driving wheel is present in said frame for rotating the threaded bolt to displace the slotted nuts relative to one another, the driving wheel including: a circular disk-shaped plate having an edge region that is rotatably engaged in the frame, a toothed wheel connected to the circular disk-shaped plate, and an opening in the disk-shaped plate and the toothed wheel for receiving the threaded bolt therethrough, the opening having a shape matching the flattened side regions of the shaft of the threaded bolt, such that a rotation of the driving wheel results in a corresponding rotation of the threaded bolt.

26. The revetment as defined in claim 25, which is designed for one of ceilings and walls.

27. The revetment as defined in claim 25, wherein a plurality of tightening units is provided over the length of said frame regions depending on the length of said frame regions to be pulled or pressed together and on the elasticity of said membrane material.

28. The revetment as defined in claim 25, wherein light sources are present for backlighting the membrane elements.

29. The revetment as defined in claim 25, wherein border profiles are present for the accommodation of installatory components.

30. The revetment as defined in claim 25, wherein each tightening unit is positioned at a location where bending occurs on the inwardly bent frame region.

* * * * *